US006104365A

United States Patent [19]

Towler et al.

[11] Patent Number: 6,104,365

[45] Date of Patent: Aug. 15, 2000

[54] LIGHT MODULATING DEVICES

[75] Inventors: Michael John Towler, Botley; Diana Cynthia Ulrich, Oxford; Paul Bonnett, Littlemore, all of United Kingdom

[73] Assignees: Sharp Kabushiki Kaisha, Osaka, Japan; The Secretary of State for Defence in Her Britannic Majesty's Government of the United Kingdom of Great Britain and Northern Ireland, Hants, United Kingdom

[21] Appl. No.: 09/080,601

[22] Filed: May 18, 1998

[30] Foreign Application Priority Data

May 20, 1997 [GB] United Kingdom ..... 9710402

[51] Int. Cl.[7] ..... G09G 3/36

[52] U.S. Cl. ..... 345/89; 345/94

[58] Field of Search ..... 345/87, 89, 97, 345/103, 147, 204, 94, 208

[56] References Cited

U.S. PATENT DOCUMENTS

| | | | |
|---|---|---|---|
| 4,712,877 | 12/1987 | Okada et al. | 350/350 |
| 4,921,334 | 5/1990 | Akodes | 350/333 |
| 5,583,530 | 12/1996 | Mano et al. | 345/89 |

FOREIGN PATENT DOCUMENTS

| | | |
|---|---|---|
| 0261901 | 3/1988 | European Pat. Off. . |
| 0361981 | 4/1990 | European Pat. Off. . |
| 0453033 | 10/1991 | European Pat. Off. . |
| 0478043 | 4/1992 | European Pat. Off. . |
| 0484159 | 5/1992 | European Pat. Off. . |
| 0503321 | 9/1992 | European Pat. Off. . |
| 0791912 | 8/1997 | European Pat. Off. . |
| 5-027719 | 2/1993 | Japan . |
| 5-027720 | 2/1993 | Japan . |
| 9527971 | 10/1995 | WIPO . |

OTHER PUBLICATIONS

K.F. Reinhart et al.; Ferroelectrics, 1991, vol. 113, pp. 405–417; "Addressing of Ferroelectric Liquid Crystal Matrices and Electrooptical Charaterization".

P. Maltese; Mol. Cryst. Liq. Cryst., 1992, vol. 215, pp. 57–72; "Advances and Problems in the Development of Ferroelectric Liquid Crystal Displays".

W.J.A.M. Hartman; Ferroelectrics, 1991, vol. 122, pp. 1–26; "Ferroelectric Liquid Crystal Displays for Television Application".

IBM Technical Disclosure Bulletin; Feb. 1993, vol. 36, No. 2, pp. 425–426.

*Primary Examiner*—Regina Liang
*Attorney, Agent, or Firm*—Renner, Otto Boiselle & Sklar

[57] ABSTRACT

A ferroelectric liquid crystal display comprises an addressable matrix of pixels 7 and addressing circuitry comprising a data signal generator 14 for applying data signals to column electrode tracks $\mathbf{4}_1, \mathbf{4}_2 \ldots \mathbf{4}_n$ and a strobe signal generator 15 for applying strobe signals to row electrode tracks $\mathbf{5}_1, \mathbf{5}_2 \ldots \mathbf{5}_m$ in order to selectively switch the pixels 7. In order to provide a large number of well defined grey levels, the addressing circuitry includes spatial and/or temporal dither control circuits for addressing separately addressable subpixels of each pixel 7 with different combinations of spatial dither signals and/or for addressing at least part of each pixel with different combinations of temporal dither signals applied to separately addressable temporal bits corresponding to subframes of different periods to produce a plurality of different transmission levels. Furthermore at least a part of each pixel is switchable between different states by means of on and off switching signals, at least one bit of some of the pixels being switchable into intermediate states, including at least one error producing analogue state, by intermediate switching signals in order to produce intermediate overall transmission levels, and such switching being controlled so that periods in which at least part of the pixel is in an error producing analogue state alternate with periods in which the part is in a substantially error free state in order to limit the propagation of transmission errors.

18 Claims, 13 Drawing Sheets

| SD | 1 | | 2 | |
|---|---|---|---|---|
| TD | 1 | 4 | 1(2) | 4(8) |
| GL | | | | |
| 0 | 0 | 0 | 0 | 0 |
| 1 | 1 | 0 | 0 | 0 |
| 2 | 0 | 0 | 1 | 0 |
| 3 | 1 | 0 | 1 | 0 |
| 4 | 0 | 1 | 0 | 0 |
| 5 | 1 | 1 | 0 | 0 |
| 6 | 0 | 1 | 1 | 0 |
| 7 | 1 | 1 | 1 | 0 |
| 8 | 0 | 0 | 0 | 1 |
| 9 | 1 | 0 | 0 | 1 |
| 10 | 0 | 0 | 1 | 1 |
| 11 | 1 | 0 | 1 | 1 |
| 12 | 0 | 1 | 0 | 1 |
| 13 | 1 | 1 | 0 | 1 |
| 14 | 0 | 1 | 1 | 1 |
| 15 | 1 | 1 | 1 | 1 |

FIG. 6

| SD | 1 | | 2 | |
|---|---|---|---|---|
| TD | 1 | 4 | 1(2) | 4(8) |
| GL | | | | |
| 0.5 | 0.5 | 0 | 0 | 0 |
| 1.5 | 0.5 | 0 | 0.5 | 0 |
| 2.5 | 0.5 | 0 | 1 | 0 |
| 3.5 | 0.5 | 0.5 | 0.5 | 0 |
| 4.5 | 0.5 | 1 | 0 | 0 |
| 5.5 | 0.5 | 1 | 0.5 | 0 |
| 6.5 | 0.5 | 1 | 1 | 0 |
| 7.5 | 0.5 | 0.5 | 0.5 | 0.5 |
| 8.5 | 0.5 | 0 | 0 | 1 |
| 9.5 | 0.5 | 0 | 0.5 | 1 |
| 10.5 | 0.5 | 0 | 1 | 1 |
| 11.5 | 0.5 | 0.5 | 0.5 | 1 |
| 12.5 | 0.5 | 1 | 0 | 1 |
| 13.5 | 0.5 | 1 | 0.5 | 1 |
| 14.5 | 0.5 | 1 | 1 | 1 |

FIG. 7

| SD | 1 | | 2 | |
|---|---|---|---|---|
| TD | 1 | 4 | 1(2) | 4(8) |
| GL | | | | |
| 0-1 | 0-1 | 0 | 0 | 0 |
| 1-2 | 0-1 | 0 | 0.5 | 0 |
| 2-3 | 0-1 | 0 | 1 | 0 |
| . | | | | |
| . | | | | |
| . | | | | |
| 11-12 | 0 - 1 | 0.5 | 0.5 | 1 |
| . | | | | |
| . | | | | |
| . | | | | |
| 14-15 | 0-1 | 1 | 1 | 1 |

| | | | |
|---|---|---|---|
| TD + SD only | 16 grey levels | 2 data types | -------- |
| + 0.5 | 31 grey levels | 3 data types | -------- |
| + 0.25 + 0.75 | 61 grey levels | 5 data types | error < 12.5% (in fact 25% when 0, 0.5 and 1 levels are error free) |
| + ... | 181 grey levels | 13 data types | error < ~4.2% |

FIG. 8

| SD | 1 | | 2 | |
|---|---|---|---|---|
| TD | 1 | 3 | 1(2) | 3(6) |
| GL | | | | |
| 0 | 0 | 0 | 0 | 0 |
| 1 | 1 | 0 | 0 | 0 |
| 2 | 0 | 0 | 1 | 0 |
| 3 | 1 | 0 | 1 | 0 |
| 3 | 0 | 1 | 0 | 0 |
| 4 | 1 | 1 | 0 | 0 |
| 5 | 0 | 1 | 1 | 0 |
| 6 | 1 | 1 | 1 | 0 |
| 6 | 0 | 0 | 0 | 1 |
| 7 | 1 | 0 | 0 | 1 |
| 8 | 0 | 0 | 1 | 1 |
| 9 | 1 | 0 | 1 | 1 |
| 9 | 0 | 1 | 0 | 1 |
| 10 | 1 | 1 | 0 | 1 |
| 11 | 0 | 1 | 1 | 1 |
| 12 | 1 | 1 | 1 | 1 |

FIG. 9

| SD | 1 | | 2 | |
|---|---|---|---|---|
| TD | 1 | 3 | 1(2) | 3(6) |
| GL | | | | |
| 0.5 | 0.5 | 0 | 0 | 0 |
| 1.5 | 0.5 | 0 | 0.5 | 0 |
| 2.5 | 0.5 | 0 | 1 | 0 |
| 3.5 | 0.5 | 1 | 0 | 0 |
| 4.5 | 0.5 | 1 | 0.5 | 0 |
| 5.5 | 0.5 | 1 | 1 | 0 |
| 6.5 | 0.5 | 0 | 0 | 1 |
| 7.5 | 0.5 | 0 | 0.5 | 1 |
| 8.5 | 0.5 | 0 | 1 | 1 |
| 9.5 | 0.5 | 1 | 0 | 1 |
| 10.5 | 0.5 | 1 | 0.5 | 1 |
| 11.5 | 0.5 | 1 | 1 | 1 |

FIG. 10

| SD | 1 | | 2 | |
|---|---|---|---|---|
| TD | 1 | 3 | 1(2) | 3(6) |
| GL | | | | |
| 0-1 | 0-1 | 0 | 0 | 0 |
| 1-2 | 0-1 | 0 | 0.5 | 0 |
| 2-3 | 0-1 | 0 | 1 | 0 |
| 3-4 | 0-1 | 1 | 0 | 0 |
| 4-5 | 0-1 | 1 | 0.5 | 0 |
| 5-6 | 0-1 | 1 | 1 | 0 |
| 6-7 | 0-1 | 0 | 0 | 1 |
| 7-8 | 0-1 | 0 | 0.5 | 1 |
| 8-9 | 0-1 | 0 | 1 | 1 |
| 9-10 | 0-1 | 1 | 0 | 1 |
| 10-11 | 0-1 | 1 | 0.5 | 1 |
| 11-12 | 0-1 | 1 | 1 | 1 |

| | | | |
|---|---|---|---|
| TD + SD only | 13 grey levels | 2 data types | --------- |
| + 0.5 | 25 grey levels | 3 data types | --------- |
| + 0.25 + 0.75 | 49 grey levels | 5 data types | error < 12.5% (in fact 25% when 0, 0.5 and 1 levels are error free) |
| + ... | 145 grey levels | 13 data types | error < ~4.2% |

FIG. 11

| | | | | | | |
|---|---|---|---|---|---|---|
| | SD | | 1 | | | 2 |
| | TD | 1 | 3 | 12 | 1(2) | 3(6) | 12(24) |
| GL | | | | | | | |
| 0.5 | | 0.5 | 0 | 0 | 0 | 0 | 0 |
| 1.5 | | 0.5 | 0 | 0 | 0.5 | 0 | 0 |
| 2.5 | | 0.5 | 0 | 0 | 1 | 0 | 0 |
| 3.5 | | 0.5 | 1 | 0 | 0 | 0 | 0 |
| 4.5 | | 0.5 | 1 | 0 | 0.5 | 0 | 0 |
| 5.5 | | 0.5 | 1 | 0 | 1 | 0 | 0 |
| 6.5 | | 0.5 | 0 | 0 | 0 | 1 | 0 |
| 7.5 | | 0.5 | 0 | 0 | 0.5 | 1 | 0 |
| 8.5 | | 0.5 | 0 | 0 | 1 | 1 | 0 |
| 9.5 | | 0.5 | 1 | 0 | 0 | 1 | 0 |
| 10.5 | | 0.5 | 1 | 0 | 0.5 | 1 | 0 |
| 11.5 | | 0.5 | 1 | 0 | 1 | 1 | 0 |

12.5 - 23.5 as above + 12
24.5 - 35.5 as above + 24
36.5 - 47.5 as above + 12 + 24

FIG. 12

| SD | | 1 | | | 2 | |
|---|---|---|---|---|---|---|
| TD | 1 | 3 | 12 | 1(2) | 3(6) | 12(24) |
| GL | | | | | | |
| 0-1 | 0-1 | 0 | 0 | 0 | 0 | 0 |
| 1-2 | 0-1 | 0 | 0 | 0.5 | 0 | 0 |
| 2-3 | 0-1 | 0 | 0 | 1 | 0 | 0 |
| 3-4 | 0-1 | 1 | 0 | 0 | 0 | 0 |
| 4-5 | 0-1 | 1 | 0 | 0.5 | 0 | 0 |
| 5-6 | 0-1 | 1 | 0 | 1 | 0 | 0 |
| 6-7 | 0-1 | 0 | 0 | 0 | 1 | 0 |
| 7-8 | 0-1 | 0 | 0 | 0.5 | 1 | 0 |
| 8-9 | 0-1 | 0 | 0 | 1 | 1 | 0 |
| 9-10 | 0-1 | 1 | 0 | 0 | 1 | 0 |
| 10-11 | 0-1 | 1 | 0 | 0.5 | 1 | 0 |
| 11-12 | 0-1 | 1 | 0 | 1 | 1 | 0 |

12 - 24 as above + 12
24 - 36 as above + 24
36 - 48 as above + 12 + 24

| | | | |
|---|---|---|---|
| TD + SD only | 49 grey levels | 2 data types | ——— |
| + 0.5 | 97 grey levels | 3 data types | ——— |
| + 0.25 + 0.75 | 193 grey levels | 5 data types | error < 12.5% (in fact 25% when 0, 0.5 and 1 levels are error free) |

FIG. 13

| GL \ TD | 1 | 2 | 3 | 6 |
|---|---|---|---|---|
| 0.5 | 0.5 | 0 | 0 | 0 |
| 1.5 | 0.5 | 0.5 | 0 | 0 |
| 2.5 | 0.5 | 1 | 0 | 0 |
| 3.5 | 0.5 | 0 | 1 | 0 |
| 4.5 | 0.5 | 0.5 | 1 | 0 |
| 5.5 | 0.5 | 1 | 1 | 0 |
| 6.5 | 0.5 | 0 | 0 | 1 |
| 7.5 | 0.5 | 0.5 | 0 | 1 |
| 8.5 | 0.5 | 1 | 0 | 1 |
| 9.5 | 0.5 | 0 | 1 | 1 |
| 10.5 | 0.5 | 0.5 | 1 | 1 |
| 11.5 | 0.5 | 1 | 1 | 1 |

FIG. 14

| GL \ TD | 1 | 2 | 3 | 6 |
|---|---|---|---|---|
| 0-1 | 0-1 | 0 | 0 | 0 |
| 1-2 | 0-1 | 0.5 | 0 | 0 |
| 2-3 | 0-1 | 1 | 0 | 0 |
| 3-4 | 0-1 | 0 | 1 | 0 |
| 4-5 | 0-1 | 0.5 | 1 | 0 |
| 5-6 | 0-1 | 1 | 1 | 0 |
| 6-7 | 0-1 | 0 | 0 | 1 |
| 7-8 | 0-1 | 0.5 | 0 | 1 |
| 8-9 | 0-1 | 1 | 0 | 1 |
| 9-10 | 0-1 | 0 | 1 | 1 |
| 10-11 | 0-1 | 0.5 | 1 | 1 |
| 11-12 | 0-1 | 1 | 1 | 1 |

| | | |
|---|---|---|
| TD only | 13 grey levels | 2 data types |
| + 0.5 | 25 grey levels | 3 data types |
| + 0.25 + 0.75 | 49 grey levels | 5 data types |
| + .... | 73 grey levels | 7 data types |
| + ... | 265 grey levels | 23 data types |

FIG. 15

LIGHT MODULATING DEVICES

TECHNICAL FIELD OF THE INVENTION

This invention relates to light modulating devices, and is concerned more particularly, but not exclusively, with liquid crystal display and optical shutter devices including spatial light modulators.

BACKGROUND OF THE INVENTION

It should be understood that the term "light modulating devices" is used in this specification to encompass both light transmissive modulators, such as diffractive spatial modulators, and light emissive modulators, such as conventional liquid crystal displays. Furthermore, in the following description, the term "analogue states" will be used to denote those switching states of the light modulating device which are subject to significant transmission errors, for example because the corresponding transmission levels depend on switching of microdomains in a liquid crystal material. Conversely the term "digital states" will be used to denote those switching states of the light modulating device having substantially error free transmission levels as a result of the fact that such levels depend on a well-defined physical property of the device, for example corresponding to the device being switched fully on or fully off or being in an error free intermediate state as discussed more fully below.

Liquid crystal devices are commonly used for displaying alphanumeric information and/or graphic images. Furthermore liquid crystal devices are also used as optical shutters, for example in printers. Such liquid crystal devices comprise a matrix of individually addressable modulating elements which can be designed to produce not only black and white, but also intermediate tones, or color variations in devices in which color filters are used. The so-called greyscale response of such a device may be produced in a number of ways.

For example, the greyscale response may be produced by modulating the transmission of each element between "on" and "off" states in dependence on the applied drive signal so as to provide different levels of analogue grey. In a twisted nematic device, for example, the transmission of each element may be determined by an applied RMS voltage and different shades of grey may be produced by suitable control of the voltage. In active matrix devices the voltage stored at the element similarly controls the grey level. On the other hand, it is more difficult to control the transmission in an analogue fashion in a ferroelectric liquid crystal device, although various methods have been reported by which the transmission may be controlled by modulating the voltage signal in such a device. In devices having no analogue greyscale, a greyscale response may be produced by so-called spatial or temporal dither techniques, or such techniques may be used to augment the analogue greyscale.

In a spatial dither (SD) technique each element is divided into two or more separately addressable subelements which are addressable by different combinations of switching signals in order to produce different overall levels of grey. For example, in the simple case of an element comprising two equal sized subelements each of which is switchable between a white state and a black state, three grey levels (including white and black) will be obtainable corresponding to both subelements being switched to the white state, both subelements being switched to the black state, and either subelement being in the white state while the other subelement is in the black state. Since both subelements are of the same size, the same grey level will be obtained regardless of which of the subelements is in the white state and which is in the black state, so that the switching circuit must be designed to take account of this level of redundancy. It is also possible for the subelements to be of different sizes which will have the effect that different grey levels will be produced depending on which of the two subelements is in the white state and which is in the black state. However a limit to the number of subelements which can be provided in practice is imposed by the fact that separate conductive tracks are required for supplying the switching signals to the subelements and the number of such tracks which can be accommodated is limited by space constraints.

In a temporal dither (TD) technique at least part of each element is addressable by different time modulated signals in order to produce different overall levels of grey. For example, in a simple case in which an element is addressable by two subframes of equal duration, the element may be arranged to be in the white state when it is addressed so as to be "on" in both subframes, and the element may be arranged to be in the black state when it is addressed so as to be "off" in both subframes. Furthermore the element may be in an intermediate grey state when it is addressed so as to be "on" in one subframe and "off" in the other subframe. The frame rate should be greater than the frequency at which the dither is observable as flickering. Furthermore it is possible to combine such a temporal dither technique with spatial dither by addressing one or more of the subelements in a spatial dither arrangement by different time modulated signals. This allows an increased range of grey levels to be produced at the cost of increased circuit complexity.

In many applications, and particularly in display devices for displaying moving graphic images, there is a requirement for a large number of suitably spaced grey levels to be generated, with minimum (and preferably no) redundancy of grey levels. Usually the grey levels are linearly spaced as far as possible. To this end the elements may be binary weighted, for example by dividing each element into subelements having surface areas in the ratio 1:2:4 in a SD technique or by addressing of each element with frames having durations in the ratio 1:4 in a TD technique. European Patent Publication No. 0261901A2 discloses a method of maximizing the number of grey levels that can be obtained from a certain number of binary temporal divisions of the addressing frame by dividing the addressed rows of the display matrix into groups and addressing the groups sequentially.

European Patent Publication No. 0478043A1 discloses a method of producing a large number of grey levels by combining spatial dither with an analogue switching arrangement so that at least one of the subelements of each element has more than two switching states, that is a black state 0, a white state 1 and at least one intermediate state having a grey level between 0 and 1. For example, each element may be divided into four (column) subelements having widths in the ratio of 4:2:1:1, each of the subelements being switchable between the black state 0 and the white state 1 except for one of the two smallest subelements which is switchable between four analogue states corresponding to 0, ⅓, ⅔ and 1. Taking account of the relative surface areas of the four subelements, it is possible to obtain a total of 32 different grey levels by combining the switching of the four spatial bits with appropriate selection of the different analogue states of the smallest at subelement having the four states 0, ⅓, ⅔ and 1. Provision of such an additional spatial bit having more than two analogue states allows further intermediate grey levels to be produced, and the fact that the spatial bit is a bit of small size means that any errors in the analogue levels are not magnified. However such an arrangement leads to additional circuit complexity and cost, and there are difficulties in manufacturing devices, particularly color display devices, in which a very high density of electrode tracks is required to address the required subelements.

European Patent Publication No. 0361981 discloses a method of maximizing the number of grey levels that can be obtained from a certain number of subpixels in a SD arrangement by dividing each pixel up into n subpixel groups having surface areas in the ratio A1:A2 . . . : $An=m^{n-1}:m^{n-2}:1$ where m represents the number of grey levels of each subpixel. Where each subpixel has only two grey levels, that is black and white, and there are three subpixel groups, therefore, the optimized ratio of the surface areas of the subpixel groups is 4:2:1, for example. Different optimized ratios are obtained if each subpixel group has more than two grey levels or if more than three subpixel groups are provided. However such an arrangement may again be limited in its application due to difficulties in manufacturability or manufacturing cost considerations.

W. J. A. M. Hartman, "Ferroelectric liquid crystal displays for television application", Ferroelectrics 1991, Vol. 122, pp.1–26, discloses certain optimum combinations of SD and TD ratios for use in ferroelectric liquid crystal display devices to obtain a large number of spaced grey levels. This reference also describes various methods of achieving different levels of analogue greyscale such as the texture method in which variation in the texture of the liquid crystal material in dependence on the applied electric field is made use of to obtain different grey levels.

Furthermore U.S. Pat. No. 4,712,877 discloses a method of producing discrete grey states within a pixel of a ferroelectric liquid crystal display device by a technique called multi-threshold modulation (MTM), generally by variation of the electric field over the pixel area. For example the liquid crystal thickness may be varied over the pixel area in steps. This method may be combined with dither techniques in order to produce a large number of grey levels, although in practice it is difficult to address more tan a few MTM grey states.

There are a number of inherent physical problems encountered in ferroelectric liquid crystal display devices which result in finite errors in the analogue grey states, and which can accordingly result in unpredictable variation of grey levels with time and/or over the display area. Such problems are discussed in P. Maltese, "Advances and problems in the development of ferroelectic liquid crystal displays", Mol. Cryst. Liq. Cryst. 1992, Vol. 215, pp. 57–72, as well as in K. F. Reinhart, "Addressing of ferroelectric liquid crystal matrices and electrooptical characterisation", Ferroelectrics 1991, Vol.113, pp. 405–417. As is well known, analogue grey states are highly temperature dependent, and the latter reference gives an example in which the display temperature should be uniform to 0.2 degrees if 16 grey levels are required. Both references indicate that the use of tin film transistors for the drive circuitry is advantageous to achieve analogue grey states in such devices.

British Patent Application No. 9603506.8 and Japanese Patent Publications Nos. 27719/1993 and 27720/1993 describe techniques for reducing the error in a 50% analogue grey state to substantially zero by dividing each row (strobe) electrode into two subrows and simultaneously addressing the two subrows such that any local temperature variation has opposite effects in the two subrows tending to cancel the temperature dependence of the grey state for each row. Such a technique allows a substantially error free half (50%) analogue grey state to be obtained. Japanese Patent Application No. 9-72198/1997 describes a technique for obtaining such a substantially error free half state which uses an interlace technique to avoid the need to introduce extra subrows. The term "substantially error free" should be interpreted in this context as meaning tat the error associated with such a state is small by comparison with the errors associated with analogue intermediate grey states produced by conventional means.

SUMMARY OF THE INVENTION

It is an object of the invention to provide an addressing scheme for a light modulating device, such as a ferroelectric liquid crystal display device, which is capable of producing a large number of grey levels whilst minimizing the errors in such grey levels due to temperature, etc.

According to the present invention there is provided a light modulating device comprising an addressable matrix of modulating elements, and addressing means for selectively addressing each element in order to vary the transmission level of the element relative to the transmission levels of other elements, the addressing means including spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching at least a part of each element between different states corresponding to different transmission levels by means of on and off switching signals, whereby a plurality of different overall transmission levels are obtainable by selection of different combinations of spatial and/or temporal dither signals and switching signals, characterised in that the state selection means is arranged to additionally apply at least one intermediate switching signal for producing at least one intermediate state in at least one bit of at least one element, including at least one error-producing analogue state, in order to obtain intermediate overall transmission levels and to control such switching such that, for each such intermediate overall transmission level requiring at least one error producing state, periods in which at least part of the element is in an error producing analogue state alternate with periods in which said part is in a substantially error free state during production of that transmission level.

Such an arrangement is particularly applicable to display devices in which the accuracy of analogue states obtainable is insufficient to allow an analogue only device to be produced but in which certain restrictions apply to prevent a digital only device being produced. In this case a display device of good quality having a large number of well defined grey levels can be produced by combining analogue and digital states and by ensuring that the error producing analogue states are preceded by substantially error free states so that such errors are not propagated between successive addressing frames or subframes. The arrangement can be used to increase the allowed error in the analogue states by removing the most significant sources of error, as explained more fully below.

Preferably the state selection means is arranged to apply at least one intermediate switching signal so as to produce less intermediate states in the most significant bit or more significant bits than in the least significant bit or lesser significant bits in order to limit the errors associated with error producing analogue states. Clearly this serves to limit the total errors by biasing the error producing states towards the bits of lesser significance.

Most preferably the state selection means is arranged to control switching such that each error producing analogue state is preceded by a substantially error free state.

The state selection means may be arranged to control switching such that, during addressing of separately addressable temporal bits of an element in successive subframes, a temporal bit of the element in an error producing analogue state is preceded by a temporal bit of the element in a substantially error free state.

Alternatively or additionally the state selection means may be arranged to control switching such that, during addressing of separately addressable spatial bits of an element, the switching of one spatial bit of the element into an error producing analogue state in a first addressing frame is preceded by the switching of said one spatial bit into a substantially error free state in a second addressing frame immediately preceding the first addressing frame.

Furthermore the substantially error free state may be a state in which said part is in a fully off switching state or a filly on switching state. Alternatively the substantially error free state is a state in which said part is in an intermediate switching state.

In a preferred embodiment the state selection means is arranged to apply an intermediate switching signal producing a substantially error free intermediate state. Preferably the state selection means is arranged to apply on and off switching signals producing approximately 100% and 0% transmission and an intermediate switching signal producing approximately 50% transmission.

In order to confine the error producing states to the least significant bit or lesser significant bits, the state selection means may be arranged to address the least significant bit or lesser significant bits of each element with different switching signals for switching said bit between different switching states including at least one error producing analogue state. Preferably the state selection means is arranged to address the least significant bit or lesser significant bits of each element with switching signals including three different switching signals corresponding to approximately 0%, 50% and 100% transmission, the 50% transmission state being substantially error free.

Furthermore the state selection means may be arranged to address the least significant bit or lesser significant bits of each element with further intermediate switching signals to produce milder intermediate overall transmission levels between the transmission levels corresponding to said different switching signals.

Preferably the dither means is arranged to address one or more spatial bits of each element in two or more temporal subframes of different periods such that said intermediate switching signal producing said intermediate state is applied only to said spatial bit or bits in a least significant one, or lesser significant ones, of said subframes.

In order to reduce transmission level drift during continuous refreshing, the dither means is preferably arranged to address said one or more spatial bits of each element in said least significant subframe or lesser significant subframes immediately after addressing of said spatial bit or bits of the element in one of said subframes of greater significance within the same addressing frame.

Furthermore, in order to reduce dependence on the previous switched state, the state selection means may be arranged to vary the switching signal for the least significant bit or lesser significant bits of each element in said least significant subframes or lesser significant subframes between two or more different switching signals producing the same transmission level depending on the preceding states in one or more subframes of greater significance within the same addressing frame.

Also, in order to reduce pixel pattern dependence, the state selection means may be arranged to apply said intermediate switching signal in a selected temporal subframe when a data signal is applied to a corresponding column electrode such that less intermediate states are produced in one or more subframes corresponding to a preceding and/or following data signal applied to said column electrode than are produced in said selected subframe.

Advantageously the dither means is arranged to address the spatial and/or temporal bits of each element such as to produce certain degenerate overall transmission levels in which the same overall transmission level is obtainable by two or more different combinations of spatial and/or temporal dither signals and switching signals.

It is preferred that each element is in the form of a single spatial bit, and the dither means is arranged to address each element with temporal dither signals applied during subframes of different periods.

BRIEF DESCRIPTION OF THE DRAWINGS

In order that the invention may be more fully understood, various addressing schemes for use in light modulating devices in accordance with the invention will now be described, by way of example, with reference to the accompanying drawings, in which:

FIG. 6 illustrates a prior art addressing scheme in which 16 digital grey levels are obtained using a combination of SD 1:2 and TD 1:4;

FIG. 7 illustrates 15 intermediate grey levels which may be produced by the addition of a substantially error free half level and which may be added to the grey levels of FIG. 6;

FIG. 8 illustrates a range of addressing schemes for devices in accordance with the invention using a combination of SD 1:2 and TD 1:4;

FIG. 9 illustrates an addressing scheme in which 13 digital grey levels are obtained using a combination of SD 1:2 and TD 1:3;

FIGS. 10 and 11 illustrate a range of addressing schemes for devices in accordance with the invention using a combination of SD 1:2 and TD 1:3;

FIGS. 12 and 13 illustrate a range of addressing schemes for devices in accordance with the invention using a combination of SD 1:2 and TD 1:3:12;

FIGS. 14 and 15 illustrate a range of addressing schemes for devices in accordance with the invention using TD 1:2:3:6 and no SD;

DETAILED DESCRIPTION OF THE INVENTION

Figure 1:
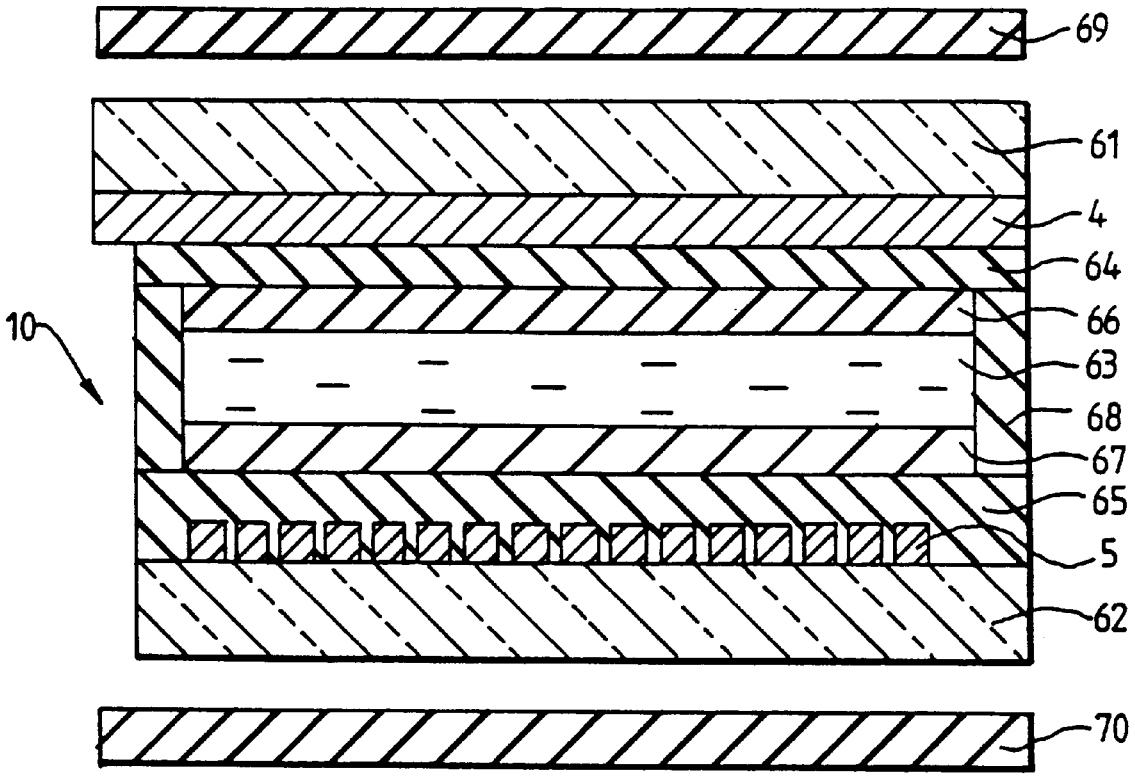
FIG. 1 is a diagrammatic section through a ferroelectric liquid crystal display panel.

The following description will be given by way of example with reference to a large ferroelectric liquid crystal display (FLCD) panel 10 shown diagrammatically in FIG. 1. The FLCD panel 10 comprises a layer 63 of ferroelectric liquid crystal material contained between two parallel glass substrates 61 and 62 bearing first and second electrode structures on their inside surfaces. The first and second electrode structures comprise respectively a series of column and row electrode tracks 4 and 5 which cross one another at right angles to form an addressable matrix of modulating elements (pixels). Furthermore alignment layers 66 and 67 are provided on insulating layers 64 and 65 applied on top of the column and row electrode tracks 4 and 5, so that the alignment layers 66 and 67 contact opposite sides of the ferroelectric liquid crystal layer 63 which is scaled at its edges by a sealing member 68. The panel 10 is disposed between polarizers 69 and 70 having polarizing axes which are substantially perpendicular to one another. However it will be understood that such a FLCD constitutes only one type of light modulating device to which the invention is applicable, and the following description of such a display is therefore to be considered as being given only by way of non-limiting example.

Figure 2:
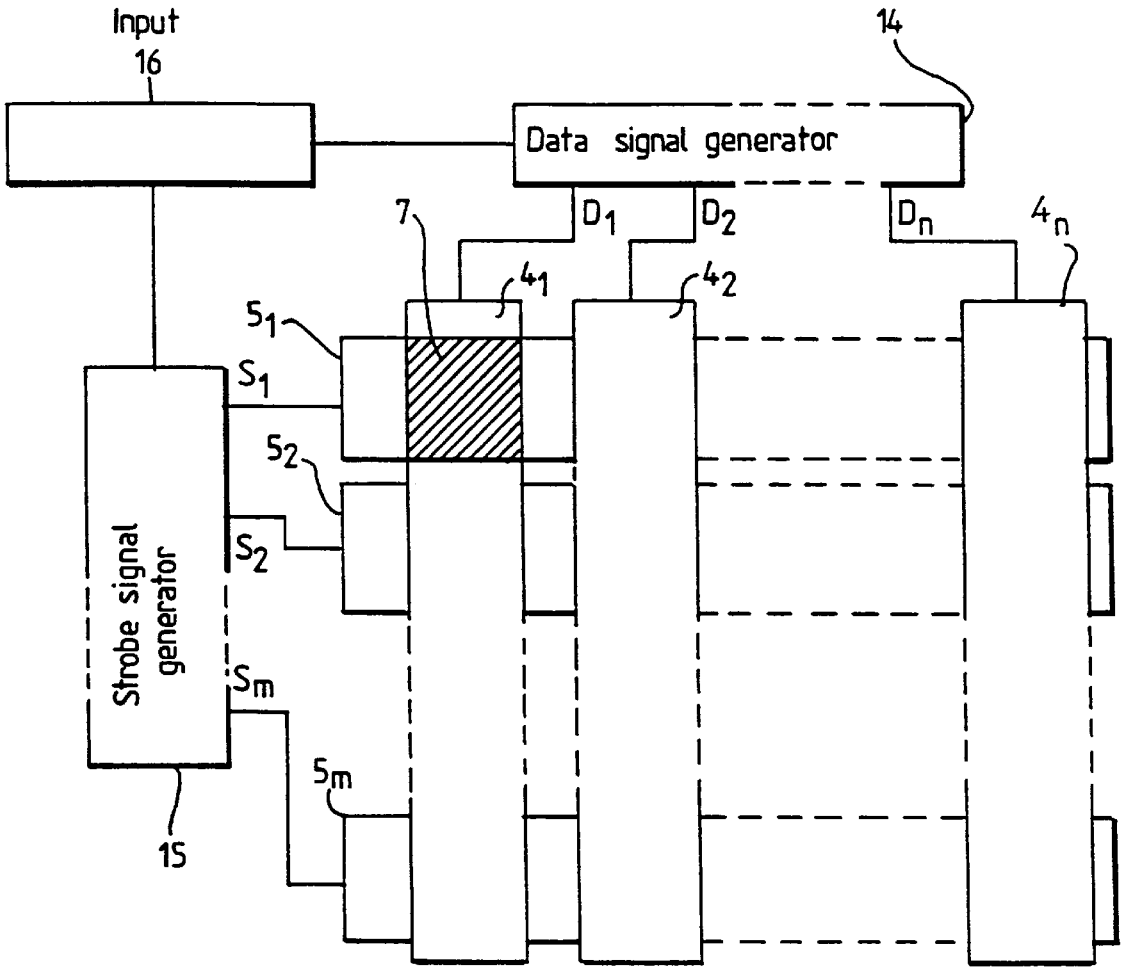
FIG. 2 is a schematic diagram illustrating an addressing arrangement for such a display panel.

FIG. 2 diagrammatically shows an addressing arrangement for such a display panel 10 comprising a data signal generator 14 coupled to the column electrode tracks $\mathbf{4}_1$, $\mathbf{4}_2$, . . . $\mathbf{4}_n$ and a strobe signal generator 15 coupled to the row electrode tracks $\mathbf{5}_1$, $\mathbf{5}_2$, . . . $\mathbf{5}_m$. The addressable pixels 7 formed at the intersections of the row and column electrode tracks are addressed by data signals $D_1$, $D_2$, . . . $D_n$, supplied by the data signal generator 14 in association with strobe signals $S_1$, $S_2$, . . . $S_m$ supplied by the strobe signal generator 15 in known manner in response to appropriate image data supplied to the data signal generator 14 and clock signals supplied to the data and strobe signal generators 14 and 15 by a display input 16 which may incorporate spatial and/or temporal dither control circuitry for effecting spatial and/or temporal dither as referred to with reference to FIGS. 4 and 5 below.

Figure 3:
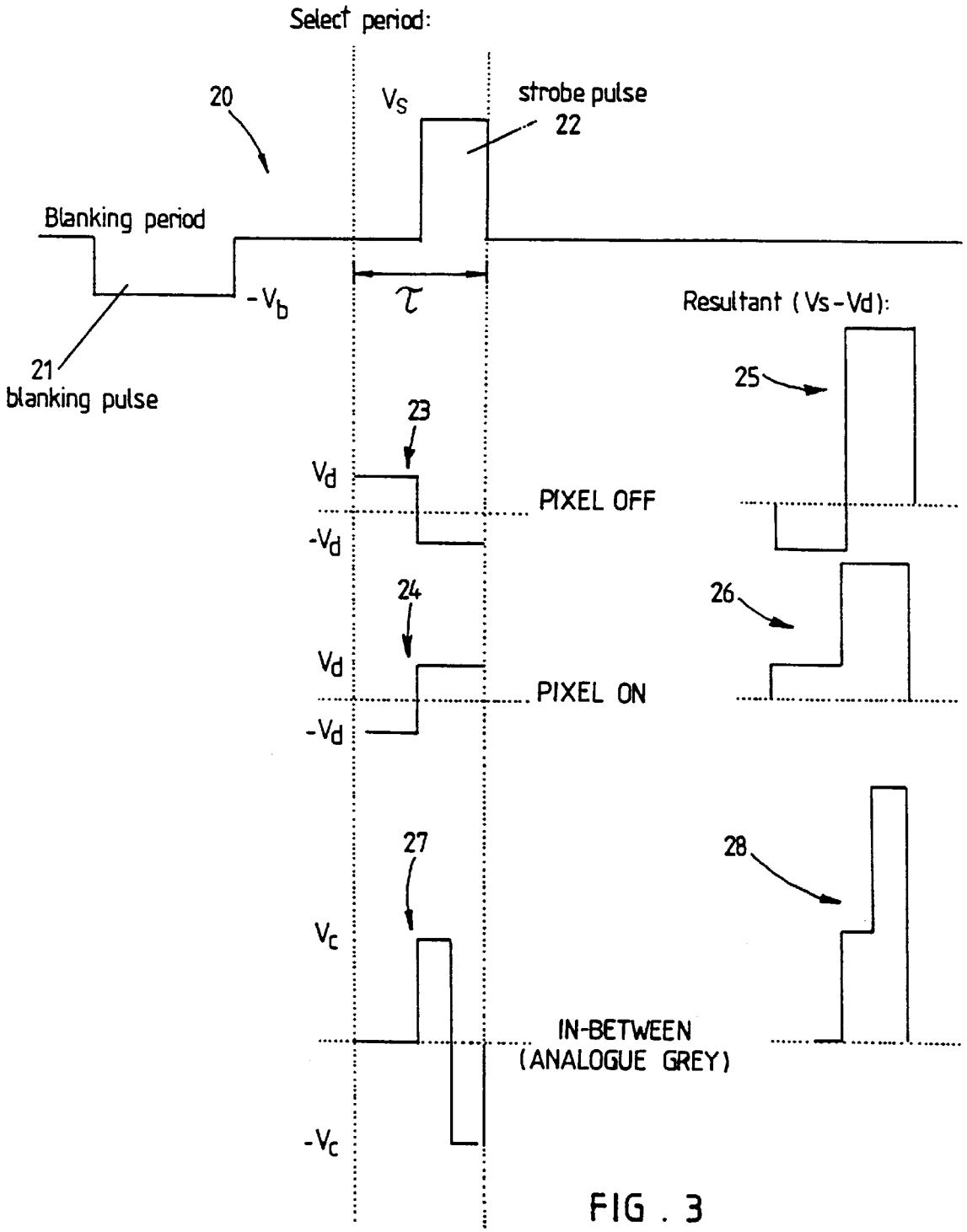
FIG. 3 is an explanatory diagram showing possible waveforms for determining the states of the pixels in such an addressing arrangement.

The manner in which the waveforms of the data and strobe signals supplied to particular column and row electrode tracks determine the switching state of a pixel will now be briefly described with reference to FIG. 3 by way of non-limiting example. FIG. 3 shows a typical strobe waveform 20 comprising a blanking pulse 21 of voltage $-V_b$ in a blanking period and a strobe pulse 22 of voltage $V_s$ in a select period of duration $\tau$, as well as a typical "off" data waveform 23 and a typical "on" data waveform 24 each comprising positive and negative pulses of voltage $V_d$ and $-V_d$. When the blanking pulse 21 is applied to the pixel, the pixel is switched to, or retained in, the normally black state or the normally white state independent of the data voltage applied to the column electrode track (the particular state being dependent on whether white or black blanking is applied). During the select period, the strobe pulse 22 is applied in synchronism with either the "off" data waveform 23 or the "on" data waveform 24 so that the resultant voltage across the pixel determines the state of the pixel and hence the transmission level. When the "off" data waveform 23 is applied, the resultant voltage 25 across the pixel causes the pixel to remain in the same state, that is the state to which the pixel has previously been blanked by the blanking pulse 21, and, when the "on" data waveform 24 is applied, the resultant voltage 26 across the pixel causes the pixel to switch to the opposite state. Furthermore an intermediate data waveform 27, for example of the form shown in FIG. 3 having positive and negative pulses of voltage $V_c$ and $-V_c$ may be applied to the pixel producing a resultant voltage 28 across the pixel which causes the pixel to assume an intermediate state corresponding to an intermediate analogue grey level.

Figure 4:
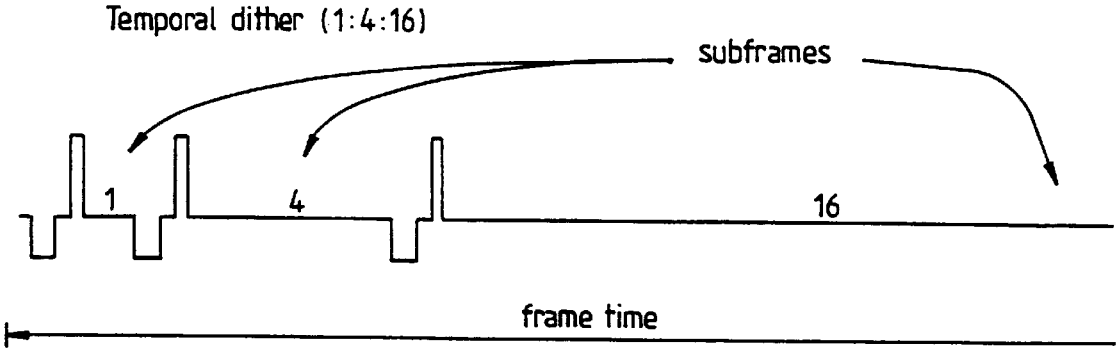
FIGS. 4 and 5 are explanatory diagrams illustrating temporal dither (TD) and spatial dither (SD) techniques.
Figure 5:
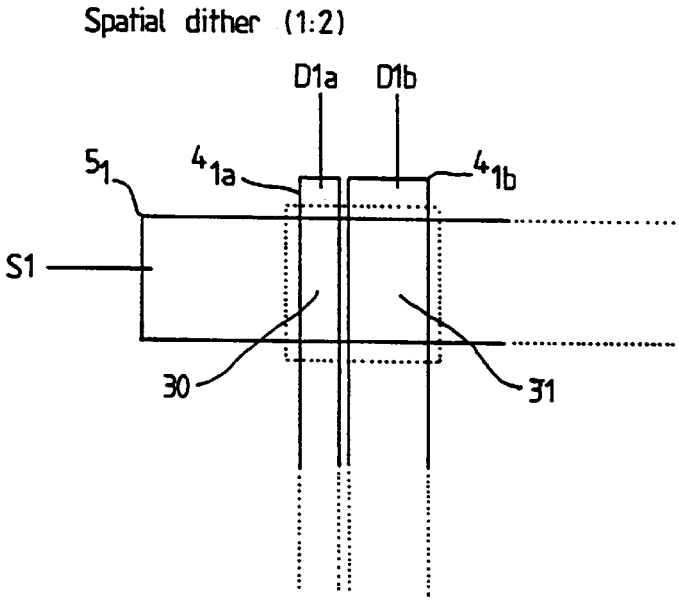

Reference will now be made to FIGS. 4 and 5 to explain possible temporal and spatial dither techniques which may be used in the addressing arrangement to obtain perceived digital grey levels in addition to the analogue grey levels obtainable by application of intermediate data waveforms such as 27 referred to above with reference to FIG. 3. FIG. 4 illustrates the timing of strobe signals applied to a particular row electrode track to achieve temporal dither during a frame time by defining three select periods in the ratio 1:4:16, for example, in which the pixel can be switched to the black state, the white state or any intermediate analogue grey state. The perceived overall grey level within the frame is the average of the transmission levels within the three sub-frames defined by the select periods. FIG. 5 shows a spatial dither arrangement given by way of non-limiting example in which each pixel comprises two sub-pixels 30 and 31 formed, for example, by the crossing points of subelectrode tracks $\mathbf{4}_{1a}$, $\mathbf{4}_{1b}$, with the strobe electrode track $\mathbf{5}_1$. Data signals $D_{1a}$, $D_{1b}$ are independently applied to the subelectrode tracks $\mathbf{4}_{1a}$, $\mathbf{4}_{1b}$ to independently control the transmission levels of the two subpixels and the average of the transmission levels of the two pixels and the ratios of the areas of the pixels determine the overall transmission level of the total pixel.

In the discussion of analogue and digital greyscale addressing given below reference will be made to "the least significant bit" and "the most significant bit", and it will be understood that the least significant bit is the bit which is of least significance amongst all the bits in determining the overall grey level, whilst the most significant bit is the bit which is of most significance amongst all the bits in determining the overall grey level. Thus, in the case of SD only addressing, the least significant bit corresponds to the subpixel of smallest area and the most significant bit corresponds to the subpixel of largest area, whereas, in the case of TD only addressing, the least significant bit corresponds to the subframe of smallest duration and the most significant bit corresponds to the subframe of greatest duration.

In order that the effect of systematic errors and random errors on the gray levels obtained in a combined analogue and digital greyscale addressing scheme can be better appreciated, the effect of such systematic and random errors will be discussed separately below, both in relation to purely analogue grey levels and grey levels obtained by a combination of analogue and digital levels, such digital levels being obtainable by SD or TD or a combination of SD and TD.

Systematic Error

If a display device is first considered which has 16 linearly spaced purely analogue grey levels 0, 1, 2, . . . 14, 15 (=0%, 6.67%, . . . 100%) in which there exists a systematic error $e_1$, due to the whole of the display not being at the optimized temperature for example, then the effect of this error will be to give grey levels such as 0, 1+$e_1$, 2+2$e_1$ . . . 5+5$e_1$, 6+6$e_1$ . . . 14+14$e_1$, 15. In this case all the intermediate grey levels between black and white are incorrect, but they are not inverted relative to one another, so that the restriction on the error will be determined by the image quality which is subjectively acceptable to the viewer. Furthermore one area of the display device may be at a temperature giving a systematic error $e_1$ whilst another area of the display may be at a different temperature giving a different systematic error $e_2$ resulting in grey levels of 0, 1+$e_2$, 2+2$_2$ . . . 5+5$e_2$, 6+6$e_2$, . . . 14+14$e_2$, 15 so that the effect of systematic error will be different in different parts of the display. The restriction on the error will again be determined by what is subjectively acceptable to the viewer.

If we then consider the case where 16 linearly spaced grey levels are obtained in a display device by a combination of analogue and digital levels (SD and/or TD) in order to give a maximum total number of linearly spaced non-degenerate analogue levels, for example by combining four linearly spaced analogue levels (0, 1, 2, 3) with TD 1:4, on the assumption that there are no errors in the analogue levels the grey levels GL5 and GL6, for example, are given by:

$$GL5(33.3\%)=[1]\times\{1\}+[4]\times\{1\}$$

$$GL6(40\%)=[1]\times\{2\}+[4]\times\{1\}$$

where [ ] represents the duration of the subframe and { } represents the analogue level, whereas, where there is a systematic geometric error e, such grey levels are given by:

$$GL5(33.3\%)=[1]\times\{1+e\}+[4]\times\{1+e\}=5+5e$$

$$GL6(40\%)=[1]\times\{2+2e\}+[4]\times\{1+e\}=6+6e$$

Thus the effect of the systematic error is the same as for the case in which pure analogue grey levels are provided. If there is a systematic error within each pixel of a display device, the required error which can be permitted for a subjectively good image is the same whether the grey levels are obtained by a purely analogue technique or by a combination of analogue and digital techniques.

Random Arithmetic Error

If we again consider a display device having 16 linearly spaced purely analogue grey levels 0, 1, 2, . . . 14, 15 (=0%, 6.67%, . . . 100%) in which in this case there exists a random arithmetic error e, the grey levels obtained in a given pixel will be 0, 1+e, 2+e, . . . 5+e, 6+e, . . . 14+e, 15. Furthermore, if the grey levels within the pixel are not to overlap, the maximum error in each grey level should be:

$$|\text{error}|\leqq 3\tfrac{1}{3}\%$$

If we then consider the case where 16 linearly spaced grey levels are obtained by a combination of analogue and digital levels (SD and/or TD), for example by combining four linearly spaced analogue levels (0, 1, 2, 3) with TD 1:4, the grey levels GL5 and GL6, for example, obtained where there are no errors in the analogue levels are given by:

$$GL5(33.3\%)=[1]\times\{1\}+[4]\times\{1\}$$

$$GL6(40\%)=[1]\times\{2\}+[4]\times\{1\}$$

whereas, where there is a random arithmetic error e, such grey levels are given by:

$$GL5(33.3\%)=[1]\times\{1+e\}+[4]\times\{1+e\}=5+5e$$

$$GL6(40\%)=[1]\times\{2+e\}+[4]\times\{1+e\}=6+5e$$

In the worst case, for the levels within the pixel not to overlap, the maximum error in each level should be:

$$|\text{error}|\leqq 3\tfrac{1}{3}\%.$$

Thus the random arithmetic error requirement is the same in the case of a combination of analogue and digital techniques as in the purely analogue case. This means that, when analogue and digital grey levels are combined in the obvious way to obtain the maximum number of grey levels, this does not lead to an improvement in the required maximum error as compared with the purely analogue case, and this is due to the propagation of the intrinsic analogue error out of the least significant bit, as will be described in more detail below With regard to the analogue greyscale errors, a significant source of such errors is insufficient erasure of previous switched states of the pixel (previous switched state dependence), and this can result in the transmission level achieved in response to applied grey scale data being biased towards the previously switched state, as well as resulting, in the case where the grey level is continuously refreshed, in the transmission level drifting from the initial biased level towards an equilibrium level as described more filly below with reference to FIG. 16. It is possible to use an addressing scheme along the lines of European Patent Publication No. 0503321A1 in order to modify the applied greyscale data signal in dependence on the previously addressed state of the pixel in order to remove some of the historical dependence of the resulting transmission level. However the embodiments of the invention to be described below utilize a particularly effective arrangement for minimizing the effect of such analogue greyscale errors. Another source of error is due to the fact that switching of a pixel can be significantly influenced by data for lines addressed just before and just after the select period (pixel pattern dependence). This problem can be overcome by designing analogue data types which are less pixel pattern dependent.

FIG. 6 shows the manner in which 16 digital grey levels are obtained using simply the states 0 (black state) and 1 (white state) and SD 1:2 combined with TD 1:4 giving, for the state 1, an overall transmission level of 1 for SD=1 and TD=1, a level of 4 for SD=1 and TD=4, a level of 2 for SD=2 and TD=1, and a level of 8 for SD=2 and TD=4. It will be appreciated that, because of the SD and TD binary weightings chosen, 16 linearly spaced digital grey levels 0, 1, 2, . . . 15 are obtained without redundancy. However, as referred to above, simply including analogue states in all four digital bits does not lead to improvement in the required maximum error as compared with the purely analogue case, since the analogue error affects the most significant digital bits.

Reference has already been made above to techniques for obtaining a substantially error free half state by dividing each row electrode into two simultaneously addressed subrows (or by interlacing to avoid the need for extra subrows) or by the MTM technique. The addition of such a substantially error free half state to the addressing scheme of FIG. 6 can be used to add substantially error free intermediate grey levels 0.5, 1.5, 2.5, . . . 14.5 as shown in FIG. 7. It should be appreciated that, although the half state is present in bits other than the least significant bit, this does not result in the addition of further error since these half states are substantially error free. It will be noted that, for the grey levels 3.5, 7.5 and 11.5, the half state is required in both addressing subframes.

In accordance with a first embodiment of the invention modulation of the analogue state of the least significant bit (SD=1 and TD=1) of such an arrangement is used to obtain further intermediate grey levels other than those corresponding to the states 0, 0.5 and 1 of the least significant bit.

FIG. 8 shows the grey levels obtainable depending on the number of data types used to modulate the least significant bit (SD=1 and TD=1), where 0–1 represents a range of grey levels between 0 and 1, for example. Thus, in the case in which there are only 2 data types in the least significant bit, that is 0 and 1, 16 substantially error free grey levels are obtained with, for example, the grey levels 0 and 1 being obtained respectively with states of 0 and 1 in the least significant bit and states of 0 in the other bits, and with the grey levels 1 and 2 being obtained respectively with the states 0 and 1 in the least significant bit and a substantially error free half state 0.5 in the bit corresponding to SD=2 and TD=1 and with the states of the other bits being 0.

In the case of 3 data types being applied to the least significant bit, that is 0, 0.5 and 1, 31 substantially error free grey levels are obtained, that is the 16 grey levels of the 2 data type embodiment together with 15 intermediate grey levels obtained with the substantially error free half state applied to the least significant bit (as shown in FIG. 7).

In the case of 5 data types being applied to the least significant bit ,that is 0, 0.25, 0.5, 0.75 and 1, 61 grey levels are obtained with a maximum required error in the analogue states of the least significant bit of the order of 12.5%. In fact this error is of the order of 25% because the 0, 0.5 and 1 states are substantially error free. Further, if 9 data types are applied to the least significant bit, 121 grey levels are obtained with a required error in the analogue states of the order of 6.25% of the maximum transmission. With 13 data types supplied to the least significant bit, 181 grey levels are obtained with the required error in the analogue states of the order of 4.2%.

Expressed generally the total number of grey levels=(N−1)(D−1)+1, where N is the number of data types and D is the number of digital levels.

Furthermore, assuming the same error on all levels, the error required to avoid grey level inversion of the levels between the digital levels is at most:

$$|\text{error}| \leq \frac{100\%}{2(N-1)}$$

In fact the error restriction is not this strict since the 0, 0.5 and 1 states are substantially error free.

It will be appreciated that the introduction of the substantially error free 0.5 state to allow substantially error free intermediate grey levels to be obtained, and the modulation of the analogue state of the least significant bit only to obtain further intermediate grey levels, reduces the overall error level by avoiding errors in bits other than the least significant bit. Furthermore, since the analogue states are only present in the least significant temporal bit, the previous temporal bit will always be addressed with 0 or 1 (corresponding to the two fully switched states) or with the substantially error free 0.5 state, and this ensures that a pixel addressed with an intermediate analogue state is never refreshed with another intermediate analogue state, thus eliminating the most significant source of grey level drift.

Reference will now be made to a different combination of SD and TD ratios, that is the combination of SD 1:2 and TD 1:3 which results in 13 overall grey levels 0, 1, 2, . . . 12 as shown in FIG. 9, but with degenerate levels 3, 6 and 9 in which two different combinations give the same overall level, such as SD=1, TD=1 in combination with SD=2, TD=1, and SD=1, TD=3 which both give the level 3.

Such degeneracy introduced by this combination of SD and TD ratios can be turned to advantage when substantially error free half states are added in order to obtain 12 intermediate grey levels 0.5, 1.5, 2.5 . . . 11.5 as shown in FIG. 10, since these intermediate grey states can be obtained without providing a half state in the most significant subframe TD=3 (as required in the previous embodiment for TD=4, SD=1 as shown in FIG. 8). If the half state is obtained by the interlace technique of Japanese Patent Application No. 9-72198/1997 referred to above, the contrast ratio would be reduced by the white blanking period if a half state were present in the most significant subframe (as in FIG. 8). However, where the intermediate states are obtained without a half state in the most significant subframe as in FIG. 10, white blanking is only needed in one subframe, thus increasing the contrast ratio.

In accordance with a second embodiment of the invention modulation of the analogue state of the least significant bit of such an arrangement is used to obtain further intermediate grey levels, as shown in FIG. 11. In the case of SD 1:2 and TD 1:3, 13 grey levels are obtainable where the least significant bit is modulated by 2 data types (0, 1), 25 grey levels are obtainable where the least significant bit is modulated by 3 data types (0, 0.51 1), 49 grey levels are obtainable where the least significant bit is modulated by 5 data types (0, 0.25, 0.5, 0.75, 1), 97 grey levels are obtainable where the least significant bit is modulated by 9 data types, and 145 grey levels are obtainable where the least significant bit is modulated by 13 data types.

Although grey level drift can be eliminated by having analogue states only in the least significant temporal bit, the problem of bias towards previously switched states still exists in order to reduce this source of error, it is possible to minimize the influence of the grey level applied during the previous frame by adopting the following procedures during addressing:

(i) Set up the ordering of the temporal bits within a frame such that the bit incorporating the analogue state follows at least one bit not incorporating an analogue state, and preferably following the most significant bit not incorporating the analogue state where more than one such bit is provided.

(ii) Determine the data type required to obtain a particular analogue state (where a choice of data types is available to obtain that level) in dependence on the state during the temporal bit preceding the bit containing the analogue state.

(iii) Modify a lookup table defining the data types required to obtain the grey levels by way of analogue and digital combinations.

When analogue states are present only in the least significant temporal bit, it is possible to address the display device such that there are only four possible pixel patterns around the analogue state select period, that is {0,analogue, 0} {0,analogue,1} {1,analogue,0} {1,analogue,1}. This allows more freedom in the design of pixel pattern independent data as the analogue states are only influenced by the data types used for the digital levels 0 and 1.

In a further, non-illustrated arrangement intermediate levels are obtained by a substantially error free half state in combination with SD 1:2 and TD 1:4:16, and this enables 64 grey levels to be obtained by modulating the least significant bit with 2 data types (0, 1), 127 grey levels to be obtained by modulating the least significant bit with 3 data types (0, 0.5, 1) and 253 grey levels to be obtained by modulating the least significant bit with 5 data types (0, 0.25, 0.5, 0.75, 1). Since the 0, 0.5 and 1 states are substantially error free, the error restriction applies only in the last case, and this will be less than 12.5% (in fact 25% because the 0, 0.5 and 1 states are error free). However, in this example, the half state is required in all three subframes, and, if the half state is obtained by the interlace technique referred to above, white blanking is required on half of the row electrodes in all three subframes. Furthermore the analogue grey state present in the least significant bit in one subframe follows on from one of only three possible states (0, 0.5 and 1) in the other subframe, and this makes it practicable to modify the data signal applied to each pixel in dependence on the previously addressed state of the display by a method such as is described in European Patent Publication No. 0503321A1 allowing the dependence of the analogue grey states the previous switching states to be effectively eliminated.

FIG. 12 illustrates a fiber arrangement in which the substantially error free half state is combined with SD 1:2 and TD 01:3:12. By reducing the temporal ratio to 1:3:12 as compared with the previously described embodiment, it is possible to obtain the intermediate grey levels with the half state being used only in the first subframe (since adequate degeneracy has been introduced). Further intermediate grey levels are obtainable by modulation of the least significant bit, as shown in FIG. 13. It will be appreciated that, in this embodiment, 49 grey levels are obtainable when the least significant bit is modulated by 2 data types (0, 1), 97 grey levels are obtainable when the least significant bit is modulated by 3 data types (0, 0.5 and 1), and 193 grey levels are obtainable when the least significant bit is modulated by 5 data types (0, 0.25, 0.5, 0.75 and 1).

FIG. 14 shows an example in which the substantially error free half state is used in an arrangement without spatial dither (SD) but with 4 bit TD 1:2:3:6. In this case the half state is provided in the first two temporal subframes. Further intermediate grey levels are obtainable by modulation of the least significant bit, as shown in FIG. 15. In this case 25 grey levels are obtainable where the least significant bit is modulated by 3 data types (0, 0.5 and 1), 49 grey levels are obtainable where the least significant bit is modulated by 5 data types (0, 0.25, 0.5, 0.75 and 1), 73 grey levels are obtainable where the least significant bit is modulated by 7 data types, and 265 grey levels are obtainable where the least significant bit is modulated by 23 data types.

Figure 16:
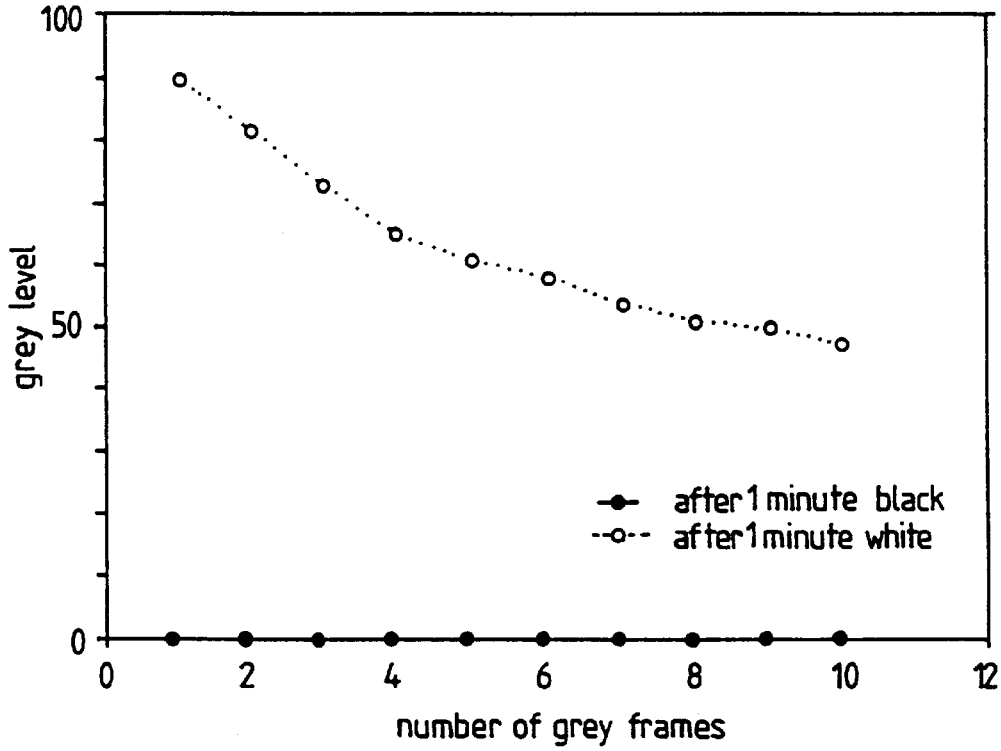
FIG. 16 is a graph of the transmission level against the addressing frames illustrating the effect of analogue greyscale errors.

The arrangement of FIG. 12 using the combination of SD 1:2 and TD 1:3:12 will now be referred to in order to demonstrate the effect of the addition of the substantially error free half state on grey level drift and error. Firstly reference should be made to FIG. 16 which shows the light transmission of a pixel in a conventional addressing scheme, such as that of FIG. 6, when the same grey level data is applied after the pixel has been in the white state for one minute (white dots) and in the black state for one minute (black dots) respectively. When the pixel has previously been in the white state, the transmission in response to application of the grey level data is biased by the previous state of the pixel and is thus 90% of the transmission of the previous state. When the grey level data is repeatedly refreshed, the transmission in each frame is 90% of that of the previous frame, and this results in grey level drift from frame to frame as the data is continuously refreshed, as shown in FIG. 16. When the pixel has previously been in the black state, the transmission level on application of the grey level data is 0% of the transmission level of the previous state, and as a result the transmission level never increases as the grey level data is repeatedly refreshed, as shown in FIG. 16. This illustrates the two types of error present in analogue greyscale, namely the effect of biasing by previous switched states and the subsequent drift of a particular grey level.

Figure 17:
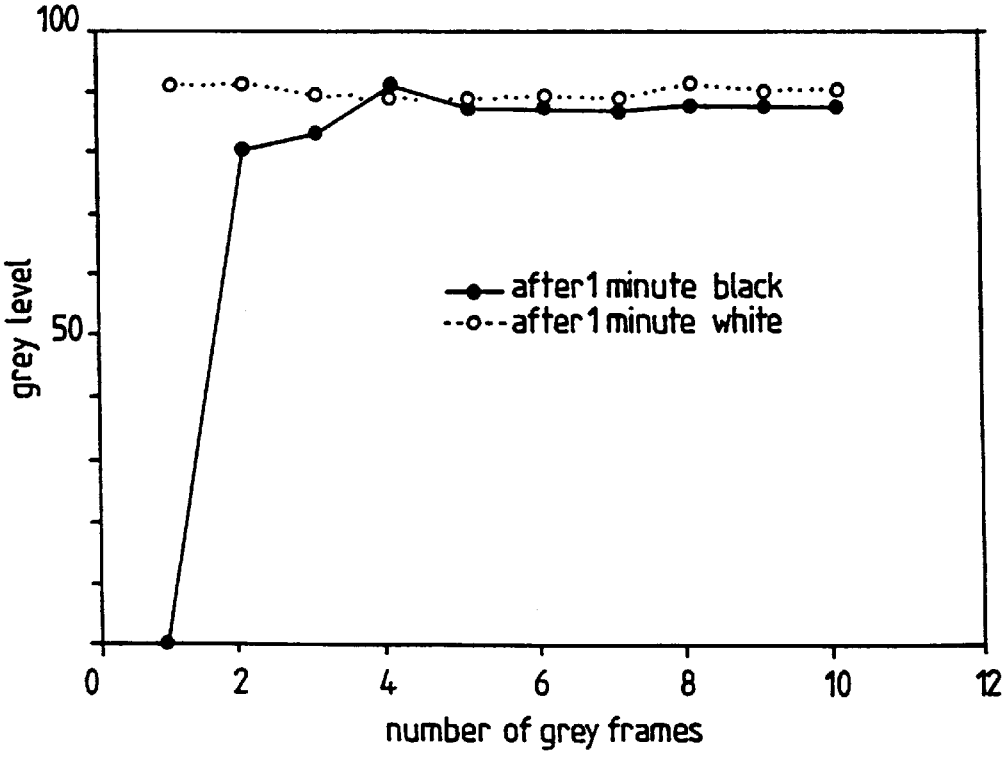
FIGS. 17, 18 and 19 are graphs of the grey level against the number of grey frames illustrating the effect of addressing schemes used in devices of the present invention.

By way of contrast, FIG. 17 shows the light transmission on application of the same grey level data following respectively one minute in the white state (white dots) and one minute in the black state (lack dots) in the case of the arrangement of FIG. 12 (SD 1:2 and TD 1:3:12) where the grey level data is applied to the least significant temporal bit (1) and the other two temporal bits (3 and 12) are addressed white. It will be appreciated that, in this case, the grey level drift is significantly reduced. The transmission level when the previous state is white is again about 90%, but the transmission level no longer reduces from frame to frame as the data is repeatedly refreshed because two subframes (3 and 12) are addressed with white before the grey level data is refreshed in the third subframe. The transmission level when the previous state is black is again about 0% of the transmission level of the previous state, but, because two subframes (3 and 12) are addressed with white before the data is refreshed, the transmission level rises to about 90% within two or more frames.

Figure 18:
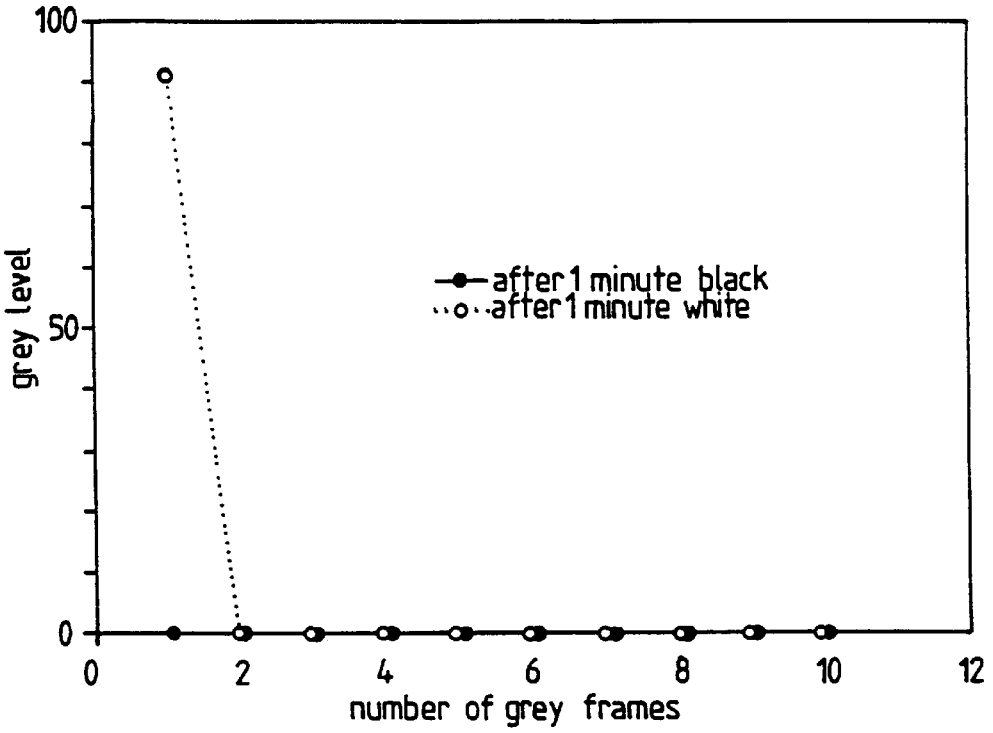

FIG. 18 shows the effect of applying the same grey level data to the least significant temporal bit (1) where the other two temporal bits (3 and 12) are addressed black instead of white. In this case the transmission level when the previous state is white is again about 90%, but, because the two preceding subframes (3 and 12) are addressed black, the transmission level falls to 0% when the data is refreshed in the second frame. Of course, when the previous state is black, the transmission level is 0% and remains at that level. Thus it is apparent, by comparing the equilibrium transmission levels of FIGS. 17 and 18, that the effect of biasing due to the states of the previous subframes causes significant error in the analogue levels, even though long term drift is removed. In order to overcome this error, it is possible to arrange for the analogue data applied in the least significant subframe to vary in dependence on the state of the previous subframe, such an arrangement requiring a frame store and means for determining the data to be applied before each refresh period. By arranging the subframes so that the analogue bit is addressed last (for example in the order 3:12:1) the analogue level in the least significant subframe will depend on the state of the pixel in the preceding most significant subframe (12). If a 90% transmission level is to be obtained in the least significant subframe, different data must be applied when the preceding most significant subframe is black as compared with the case when the preceding most significant subframe is white. As this dependence is the same for each analogue and digital combination, a fixed lookup table may be used and it is no longer necessary to use a frame store for storing the states of the previous subframes and enabling calculation of the data in dependence on such states.

Figure 19:
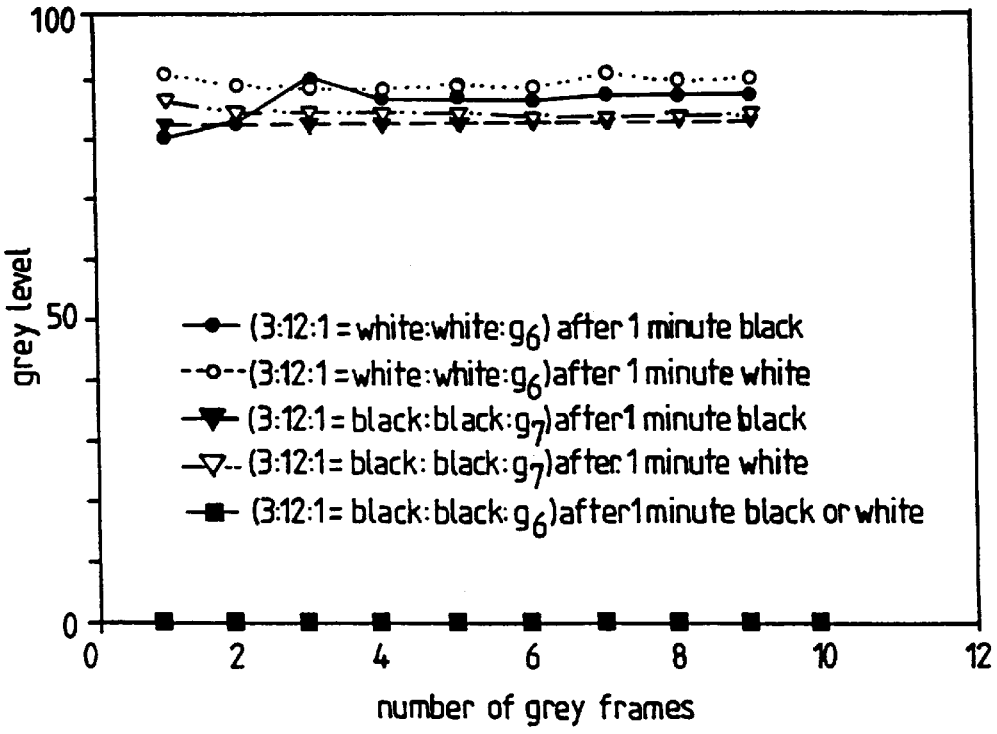

FIG. 19 shows the light transmission in such an arrangement addressed with data types $g_i$ as described in European Patent Publication No. 0710945A1 which have reduced pixel pattern dependence and therefore minimize the error in the analogue grey levels due to pixel pattern. When the two preceding subframes (3 and 12) are addressed white, the grey level data $g_6$ results in a transmission level of about 90% whether the pixel was previously in the white state for one minute (white dots) or in the black state for one minute (black dots). However, if the pixel is addressed with the same data g after the preceding two subframes (3 and 12) have been addressed black, this will result in a transmission level of 0% (as shown by the black squares in the figure) whether the pixel was previously black or white for one minute. By applying different grey level data $g_7$ in the case where the preceding subframes (3 and 12) were addressed black, however, the transmission level can be set within 10% of the desired level whether the pixel was previously white for one minute (white triangles) or black for one minute (black triangles). Thus it is possible to achieve a particular transmission level during the analogue subframe by arranging for this subframe to follow a particular digital subframe of the same frame, and preferably the most significant digital subframe, and by applying different analogue data for each state of the preceding subframe.

Figure 20:
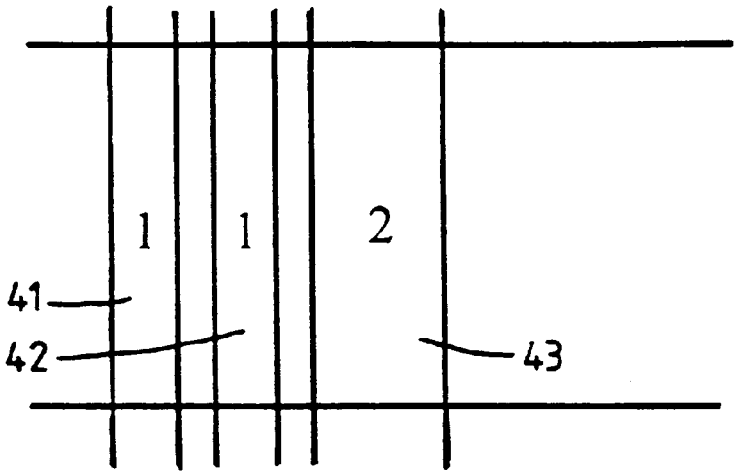
FIGS. 20 and 21 are explanatory diagrams illustrating an addressing scheme for a device in accordance with the invention using SD 1:2 and no TD.
Figure 21:
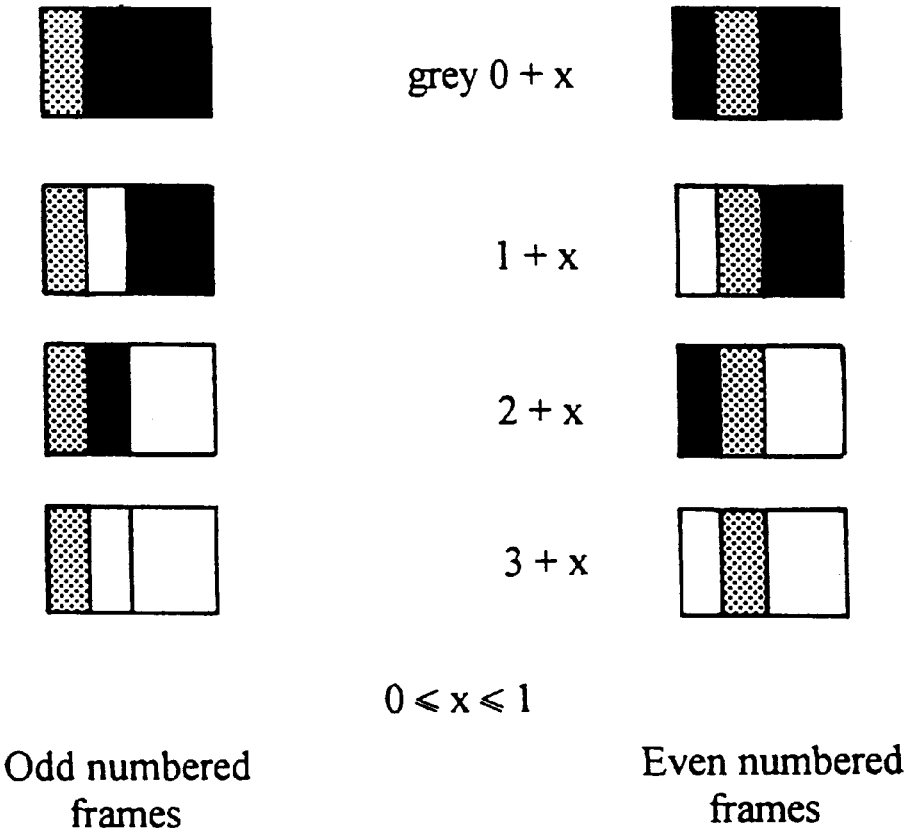

FIGS. 20 and 21 diagrammatically illustrate a further embodiment of the invention which ages purely SD with no TD. In this embodiment each pixel or subpixel is divided into three spatial bits (subpixels) 41, 42 and 43 having surface areas in the ratio 1:1:2. The most significant bit 43 is addressed so that it is always either in the state 0 (black) or in the state 1 (white). However the two least significant bits 41 and 42 may be either in the state 0 or the state 1 or in one or more intermediate analogue states, provided that the addressing of the bits 41 and 42 is such that the bits 41 and 42 are in one of the digital states (0 or 1) in alternate frames.

As shown diagrammatically in FIG. 21, for example, considering the case in which four grey levels 0+x, 1+x, 2+x and 3+x are to be obtained where $0 \leqq x \leqq 1$, the grey level 0+x is obtained with the bit 41 in an intermediate grey state and the other bits 42, 43 in the 0 state for odd numbered frames and with the bit 42 in the intermediate grey state and the other bits 41, 43 in the 0 state for even numbered frames. Similarly the grey level 1+x is obtained with the bit 41 in the intermediate grey state for odd numbered frames and the bit 42 in the intermediate grey state for even numbered frames and with the other bit 41 or 42 in the 1 state, the bit 43 again being in the 0 state. The grey level 2+x is then obtained with the bit 41 in the intermediate grey state and the bit 42 in the 0 state for odd numbered frames and with the bit 41 in the 0 state and the bit 42 in the intermediate grey state for even numbered frames, the bit 43 being in the 1 state in both cases. Furthermore the grey level 3+x is obtained with the bit 41 in the intermediate grey state and the bit 42 in the 1 state for odd numbered frames and with the bit 41 in the 1 state and the bit 42 in the intermediate grey state for even numbered frames, the bit 43 again being in the 1 state in both cases. It will be appreciated that, for each frame, only one of the least significant bits 41 and 42 is in an analogue state and, where required, the analogues states alternate between the bits 41 and 42 in successive frames, and this has the important effect that, for each of the bits 41 and 42, an error producing analogue state will always follow an error free digital state (0 or 1) of that bit in the preceding frame.

Other arrangements according to the invention can be contemplated which use purely TD but not SD and which replace the lesser significant digital bits provided in more conventional TD only addressing schemes with analogue states. In a conventional binary weighted digital addressing scheme $2^n$ grey levels are obtainable by using TD applied to successive temporal bits having weightings 1:2 . . . $2^{n-1}$. Thus, for example, such a conventional digital addressing scheme of the form TD 1:2:4:8 may produce 16 digital grey levels. By contrast 16 grey levels may be produced utilizing an embodiment of the invention in the form TD 7:8 with 8 states (2 digital and 6 intermediate analogue states) being applied to the lesser significant bit (7) to define 8 linearly spaced transmission levels. It will be appreciated that, in each case, an analogue state in the first subframe will be preceded by a digital state in the second subframe of the preceding fame.

Furthermore a conventional digital addressing arrangement TD 1:2:4:8:16:32:64:128 producing 256 grey levels may be replaced by an arrangement in accordance with the invention of the form TD 31:32:64:128 with 32 states (2 digital states and 30 intermediate analogue states) in the least significant bit defining 32 linearly spaced transmission levels so as to again produce 256 grey levels. As in the preceding embodiment each analogue state will be preceded by a digital state in the preceding subframe.

What is claimed is:

1. A light modulating device comprising an addressable matrix of modulating elements, and addressing means for selectively addressing each element in order to vary the transmission level of the element relative to the transmission levels of other elements, the addressing means including spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching at least a part of each element between different states corresponding to different transmission levels by means of on and off switching signals, whereby a plurality of different overall transmission levels are obtainable by selection of different combinations of spatial and/or temporal dither signals and switching signals, wherein the state selection means is arranged to additionally apply at least one intermediate switching signal for producing at least one intermediate state in at least one bit of at least one element, including at least one error-producing analogue state, in order to obtain intermediate overall transmission levels and to control such switching such that, for each intermediate overall transmission level requiring at least one error-producing state, periods in which at least part of the element is in the error-producing analogue state alternate with periods in which said part is in a substantially error free state during production of the transmission level.

2. The light modulating device according to claim 1, wherein the state selection means is arranged to apply at least one intermediate switching signal so as to produce less intermediate states in a most significant bit or more significant bits than in a least significant bit or lesser significant bits in order to limit the errors associated with error-producing analogue states.

3. The light modulating device according to claim 1, wherein the state selection means is arranged to control switching such that each error-producing analogue state is preceded by a substantially error free state.

4. The light modulating device according to claim 1, wherein the state selection means is arranged to control switching such that, during addressing of separately addressable temporal bits of an element in successive subframes, a temporal bit of the element in the error-producing analogue state is immediately preceded by a temporal bit of the element in the substantially error free state.

5. The light modulating device according to claim 1, wherein the state selection means is arranged to control switching such that, during addressing of separately addressable spatial bits of an element, the switching of one spatial bit of the element into the error-producing analogue state in a first addressing frame is preceded by the switching of said one spatial bit into the substantially error free state in a second addressing frame immediately preceding the first addressing frame.

6. The light modulating device according to claim 1, wherein said substantially error free state is a state in which said part is in a fully off switching state or a fully on switching state.

7. The light modulating device according to claim 1, wherein said substantially error free state is a state in which said part is in an intermediate switching state.

8. The light modulating device according to claim 1, wherein the state selection means is arranged to apply on and off switching signals producing approximately 100% and 0% transmission and an intermediate switching signal producing approximately 50% transmission.

9. The light modulating device according to claim 1, wherein the state selection means is arranged to address the least significant bit or lesser significant bits of each element with different switching signals for switching said bit between at least three different switching states including at least one error-producing analogue state.

10. The light modulating device according to claim 9, wherein the state selection means is arranged to address the least significant bit or lesser significant bits of each element with switching signals including three different switching signals corresponding to approximately 0%, 50%, and 100% transmission, the 50% transmission state being substantially error free.

11. The light modulating device according to claim 9, wherein the state selection means is arranged to address the least significant bit or lesser significant bits of each element with further intermediate switching signals to produce further intermediate overall transmission levels between the transmission levels corresponding to said different switching signals.

12. The light modulating device according to claim 1, wherein the dither means is arranged to address one or more spatial bits of each element in two or more temporal subframes of different periods such that said intermediate switching signal producing said intermediate state is applied only to said spatial bit or bits in a least significant bit, or lesser significant bits, of said subframes.

13. The light modulating device according to claim 12, wherein the dither means is arranged to address said one or more spatial bits of each element in said least significant subframe or lesser significant subframes immediately after addressing of said spatial bit or bits of the element in one of said subframes of greater significance within the same addressing frame.

14. The light modulating device according to claim 13, wherein the state selection means is arranged to vary the switching signal for the least significant bit or lesser significant bits of each element in said least significant subframe or lesser significant subframes between two or more different switching signals producing the same transmission level depending on the preceding states in one or more subframes of greater significance within the same addressing frame.

15. The light modulating device according to claim 1, wherein the state selection means is arranged to apply said intermediate switching signal in a selected temporal subframe when a data signal is applied to a corresponding column electrode such that less intermediate states are produced in one or more subframes corresponding to a preceding and/or following data signal applied to said column electrode than are produced in said selected subframe.

16. The light modulating device according to claim 1, wherein the dither means is arranged to address the spatial and/or temporal bits of each element such as to produce certain degenerate overall transmission levels in which the same overall transmission level is obtainable by two or more different combinations of spatial and/or temporal dither signals and switching signals.

17. The light modulating device according to claim 1, which is a ferroelectric liquid crystal device.

18. A light modulating device comprising an addressable matrix of modulating elements, and addressing means for selectively addressing each element in order to vary the transmission level of the element relative to the transmission levels of other elements, the addressing means including spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching at least a part of each element between different states corresponding to different transmission levels by means of on and off switching signals, whereby a plurality of different overall transmission levels are obtainable by selection of different combinations of spatial and/or temporal dither signals and switching signals, wherein:

the state selection means is arranged to additionally apply at least one intermediate switching signal for producing at least one intermediate state in at least one bit of at least one element, including at least one error-producing analogue state, in order to obtain intermediate overall transmission levels and to control such switching such that, for each intermediate overall transmission level requiring at least one error-producing state, periods in which at least part of the element is in the error-producing analogue state alternate with periods in which said part is in a substantially error free state during production of the transmission level; and the state selection means is arranged to apply at least one intermediate switching signal so as to produce less intermediate states in a most significant bit or more significant bits than in a least significant bit or lesser significant bits in order to limit the errors associated with error-producing analogue states.

* * * * *